US006066052A

United States Patent [19]

Li

[11] Patent Number: 6,066,052

[45] Date of Patent: May 23, 2000

[54] GOLF CLUB WITH A LASER SIGHT

[76] Inventor: Chien-He Li, P.O. Box 82-144, Taipei, Taiwan

[21] Appl. No.: 09/368,146

[22] Filed: Aug. 5, 1999

[51] Int. Cl.[7] ..... A63B 69/36

[52] U.S. Cl. ..... 473/220; 362/259

[58] Field of Search ..... 473/219, 220, 473/221, 223; 362/259; 434/252

[56] References Cited

U.S. PATENT DOCUMENTS

| | | | |
|---|---|---|---|
| 5,388,832 | 2/1995 | Hsu | 473/220 |
| 5,611,739 | 3/1997 | Carney | 473/220 |
| 5,697,700 | 12/1997 | Huang | 362/259 |
| 5,709,609 | 1/1998 | Carney | 473/220 |
| 5,738,595 | 4/1998 | Carney | 473/209 |
| 5,839,969 | 11/1998 | Klouda | 473/220 |
| 5,944,410 | 8/1999 | Chiou et al. | 362/259 |
| 5,993,026 | 11/1999 | Wu | 362/259 |

*Primary Examiner*—Kien T. Nguyen

*Attorney, Agent, or Firm*—A & J

[57] ABSTRACT

A golf club with a laser sight includes a shaft having a lower end provided with a club head, a metal tubular portion provided on a top of the club head, a laser generator fitted within the tubular portion and provided with a first electrode at a cylindrical surface thereof and a second electrode at an end thereof, a conductive spring connected with the second electrode of the laser generator, a tubular insulator fitted within the tubular portion, a plurality of batteries connected in series and fitted within the tubular insulator, a cover threadedly engaged with the tubular portion and having a center hole, a circular insulator arranged between the batteries and the cover, an adjust screw threadedly engaged with the center hole of the cover and having an inner end provided with a projection, whereby when the adjust screw is turned into the cover to contact an electrode of the batteries, a closed will be formed thereby providing power to the laser generator and therefore causing the laser generator to emit a laser beam, and when the adjust screw is turned out of the cover, the circuit will be opened thereby turning off the laser generator.

2 Claims, 4 Drawing Sheets

GOLF CLUB WITH A LASER SIGHT

BACKGROUND OF THE INVENTION

1. Field of the Invention

This invention is related to a golf club with a laser sight and in particular to one which can assist a beginner to practice striking a golf ball.

2. Description of the Prior Art

It has been found that a conventional golf club has a seat mounted at the lower portion of the club head provided with a laser generator therein. A reflective mirror is used for reflecting the laser beam of the laser generator to indicate the striking path. However, such a conventional golf club still suffers from the following drawbacks:

a. It is necessary to force the golf club downwardly in order to turn on the power. However, the ground of the golf course is soft so that once the golf club is forced downwardly, the club head will be located at a lower position than the golf ball thereby making it impossible to emit laser beam to the golf ball. If the golf club is slightly lifted, the power will be turned off and no laser beam will be given out of the laser generator.

b. As the golf club is first forced downwardly to turn on the power, it is necessary to the release the force before string the golf ball thereby making it difficult to control.

c. The indicator is inserted in the seat and so the reflective mirror is easily disengaged from the indicator in use.

d. The electrodes in the seat are easily corroded thus making the laser generator unable to work properly.

e. The mounting of the laser sight is very complicated and cannot be exactly mounted in the seat hence decreasing the accuracy thereof.

Therefore, it is an object of the present invention to provide an improved golf club with a laser sight which can obviate and mitigate the above-mentioned drawbacks.

SUMMARY OF THE INVENTION

This invention is related to a golf club with a laser sight and in particular to one which can assist a beginner to practice striking a golf ball. According to preferred embodiment of the present invention, a golf club with a laser sight includes a shaft having a lower end provided with a club head, a metal tubular portion provided on a top of the club head, a laser generator fitted within the tubular portion and provided with a first electrode at a cylindrical surface thereof and a second electrode at an end thereof, a conductive spring connected with the second electrode of the laser generator, a tubular insulator fitted within the tubular portion, a plurality of batteries connected in series and fitted within the tubular insulator, a cover threadedly engaged with the tubular portion and having a center hole, a circular insulator arranged between the batteries and the cover, an adjust screw threadedly engaged with the center hole of the cover and having an inner end provided with a projection, whereby when the adjust screw is turned into the cover to contact an electrode of the batteries, a closed will be formed thereby providing power to the laser generator and therefore causing the laser generator to emit a laser beam, and when the adjust screw is turned out of the cover, the circuit will be opened thereby turning off the laser generator.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
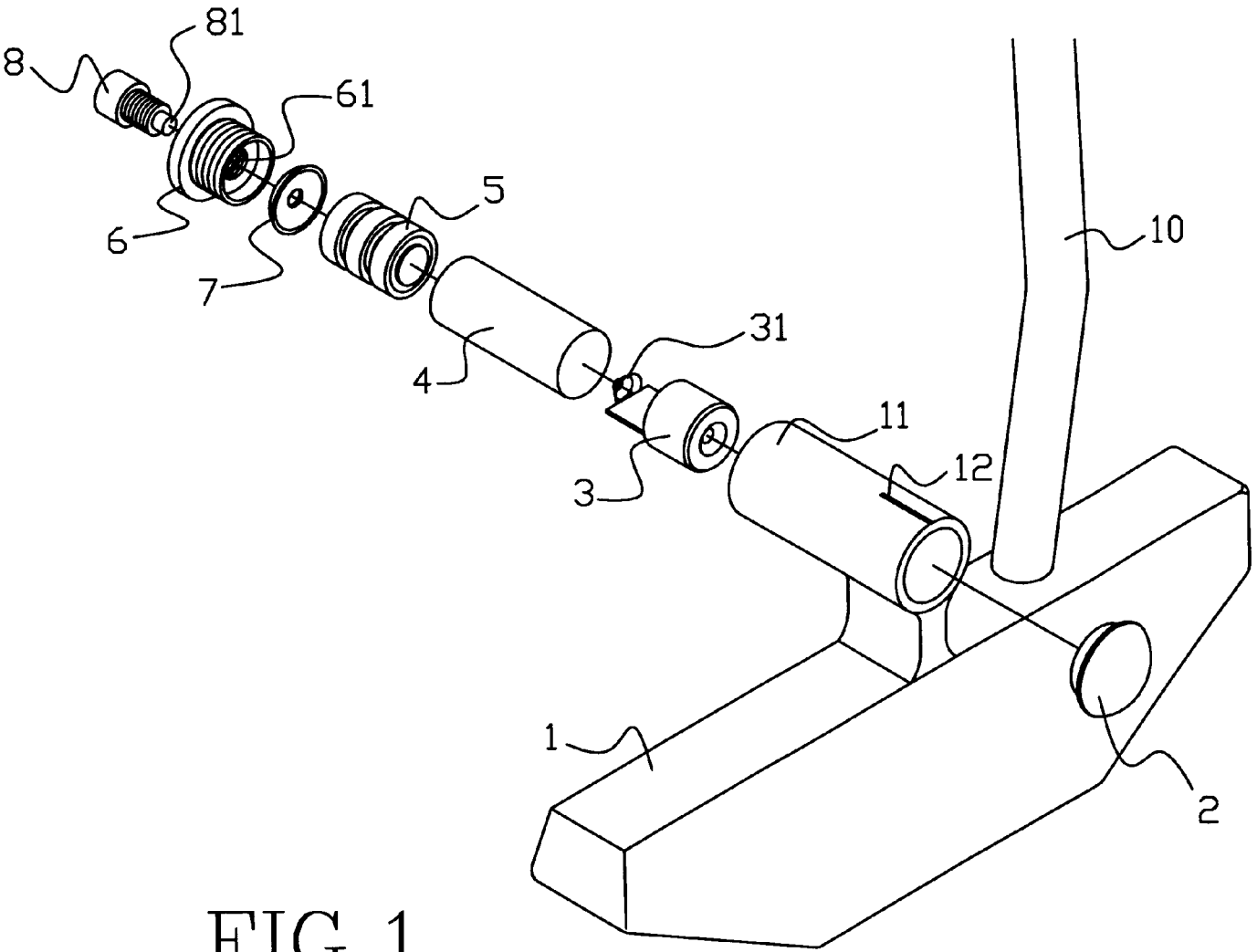
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
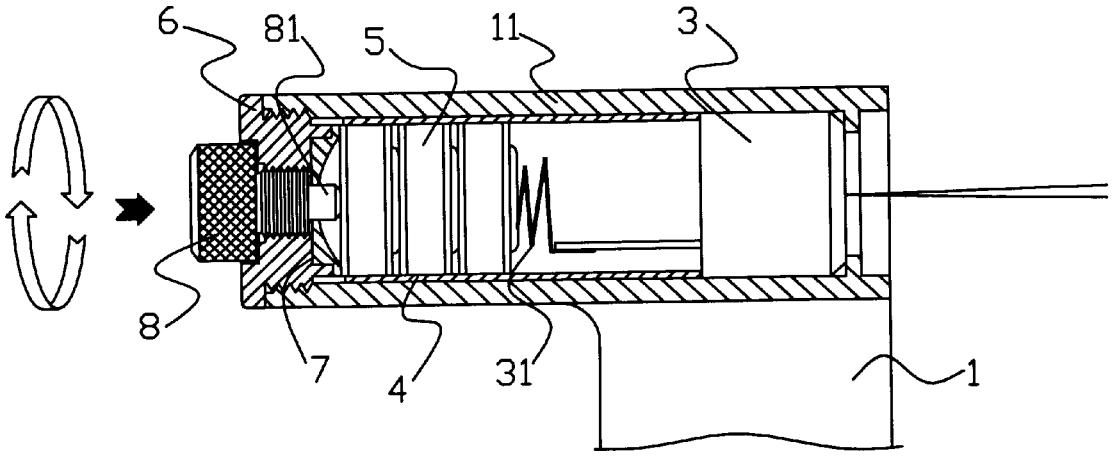
FIG. 2 is a sectional view of the present invention.
Figure 3:
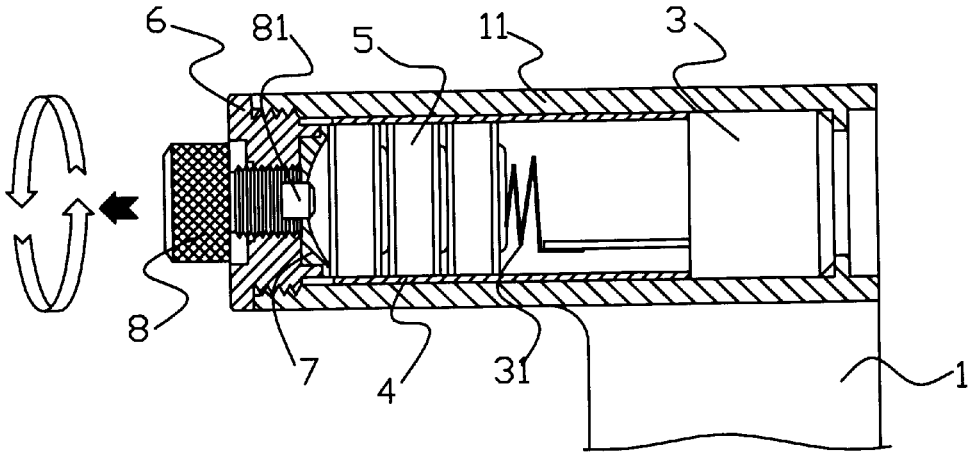
FIG. 3 illustrates how to turn off the laser generator.

With reference to the drawings and in particular to FIGS. 1 and 2 thereof, the golf club with a laser sight according to the present invention generally comprises a shaft 10 and a club head provided at a lower end of the shaft 10. The club head 1 is provided with a metal tubular portion 11 at the top thereof. The tubular portion 11 may be integrally formed with the club head 1 or may be a member engageably mounted on the tubular portion 11. The tubular portion 11 has an indicating line 12 at the top and engaged with a cap 2. A laser generator 3 is fitted within the tubular portion 11 and provided with a first electrode at its cylindrical surface and a second electrode at the left end (with respect to FIG. 1) which is connected with a conductive spring 31. A tubular insulator 4 is fitted within the tubular portion 11 for receiving a plurality of batteries 5 connected in series. A cover 6 is threadedly engaged with the tubular portion 11. A circular insulator 7 is arranged between the batteries 5 and the cover 6 so that when the cover 6 is threadedly engaged with the tubular portion 1, the circular insulator 7 will bear against the batteries 5. The cover 6 is formed with a threaded center hole 61 engageable with an adjust screw 8. The adjust screw 8 has a projection 81 at the end so that when the screw 8 is turned into the cover 6 to contact an electrode of the leftmost battery (with respect to FIG. 2), a closed circuit will be formed thereby providing power to the laser generator 3 and causing the laser generator 3 to emit a laser beam as shown in FIG. 2. When desired to turn off the laser generator 3, it is only necessary to turn the adjust screw 8 outwardly from the battery 5 (see FIG. 3) thereby opening the circuit and therefore turning off the laser generator 3.

Figure 4:
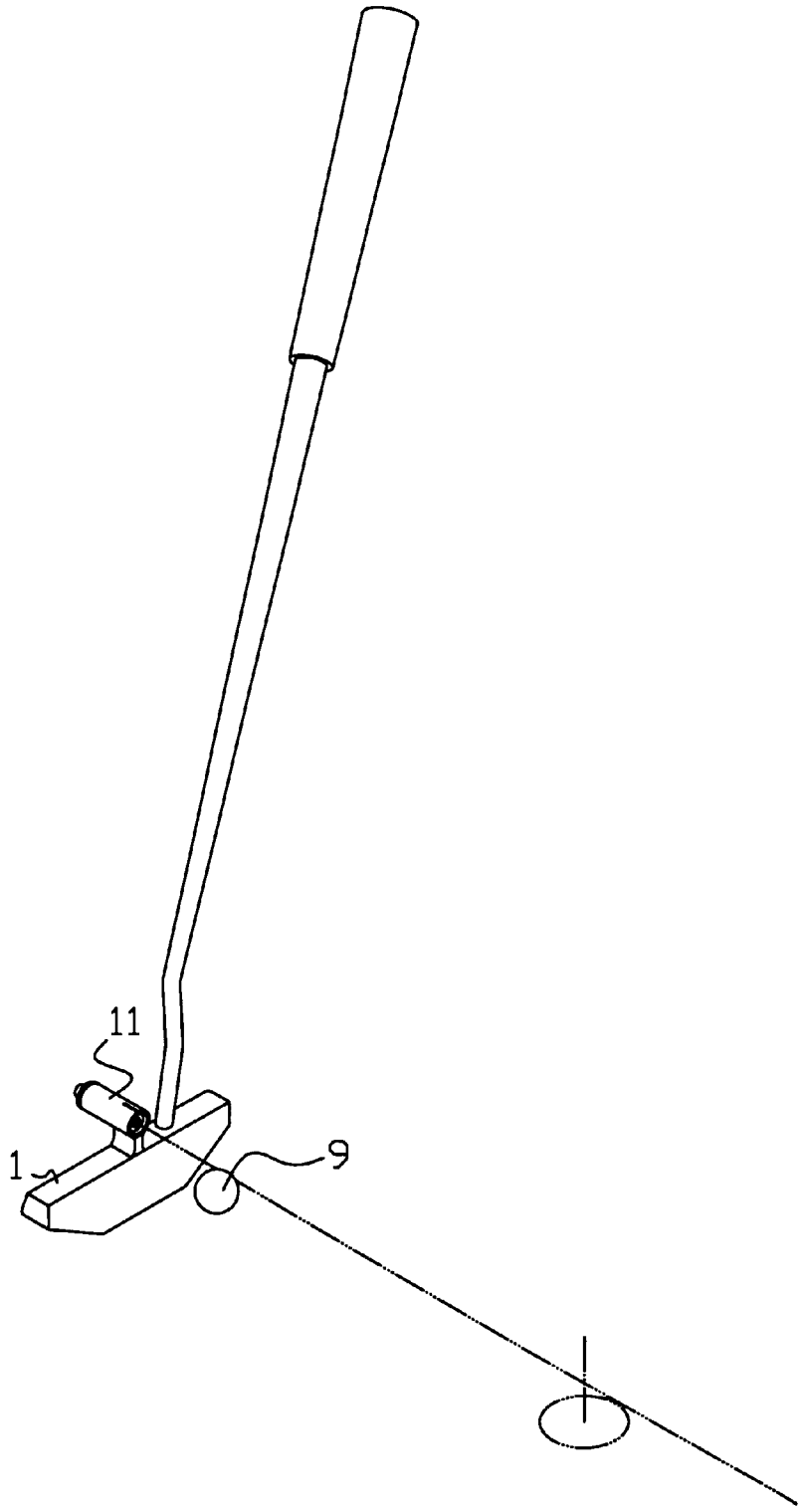
FIG. 4 is a working view of the present invention.
Figure 5:
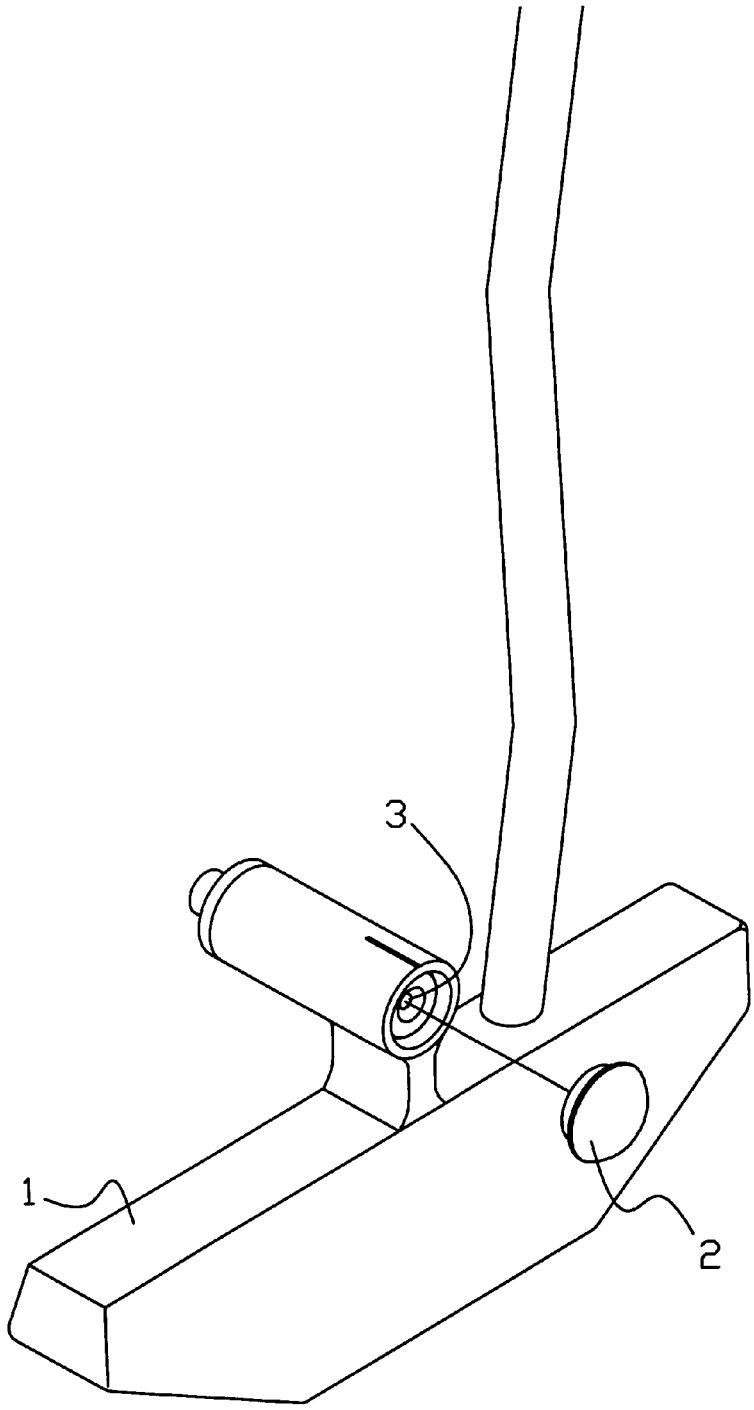
FIG. 5 illustrates how the cap is engaged with the club head.

Referring to FIG. 4, the tubular portion 11 is integrally formed with the club head 1 and higher than the golf ball 9, so that when the laser generator 3 is turned on, a laser beam will be emitted to indicate the path for striking the golf ball 9. When not in use, the tubular portion 11 may be covered with the cap 2 for preventing dust or the like from going therein.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A golf club with a laser sight comprising:

a shaft having a lower end provided with a club head;

a metal tubular portion provided on a top of said club head;

a laser generator fitted within said tubular portion and provided with a first electrode at a cylindrical surface thereof and a second electrode at an end thereof;

a conductive spring connected with said second electrode of said laser laser;

a tubular insulator fitted within said tubular portion;

a plurality of batteries connected in series and fitted within said tubular insulator;

a cover threadedly engaged with said tubular portion and having a center hole;

a circular insulator arranged between said batteries and said cover;

an adjust screw threadedly engaged with said center hole of said cover and having an inner end provided with a projection;

whereby when said adjust screw is turned into said cover to contact an electrode of said batteries, a closed will be formed thereby providing power to said laser generator and therefore causing said laser generator to emit a laser beam, and when said adjust screw is turned out of said cover, said circuit will be opened thereby turning off said laser generator.

2. The golf club with a laser sight as claimed in claim 1, wherein said tubular portion is engageable with said club head.

* * * * *